United States Patent [19]

Buhr

[11] 4,392,330

[45] Jul. 12, 1983

[54] CASEMENT WINDOW

[75] Inventor: Terry J. Buhr, Pella, Iowa

[73] Assignee: Rolscreen Company, Pella, Iowa

[21] Appl. No.: 269,628

[22] Filed: Jun. 2, 1981

[51] Int. Cl.[3] ..... E05D 15/00

[52] U.S. Cl. ..... 49/381; 49/260; 49/388; 160/92

[58] Field of Search ..... 49/176, 177, 381, 388, 49/188, 189, 154, 260; 160/186, 187, 92

[56] References Cited

U.S. PATENT DOCUMENTS

| | | | |
|---|---|---|---|
| 726,362 | 4/1903 | Shrivell . | |
| 1,600,796 | 9/1926 | Campbell . | |
| 1,781,272 | 11/1930 | Cummings . | |
| 1,844,002 | 2/1932 | Bliss . | |
| 2,276,729 | 3/1942 | Kuyper . | |
| 2,710,751 | 6/1955 | Dubiel . | |
| 3,041,680 | 7/1962 | Gurniak | 49/177 X |
| 3,250,038 | 5/1966 | Steel | 49/388 X |
| 3,589,067 | 6/1971 | Knapp | 49/177 |

*Primary Examiner*—Philip C. Kannan

*Attorney, Agent, or Firm*—Allegretti, Newitt, Witcoff & McAndrews, Ltd.

[57] ABSTRACT

A casement window is operable in a vent-egress mode and a wash mode. Hinge assemblies are mounted to the sash and hinge lock assemblies are engaged by the hinge assemblies. Both hinge and hinge lock assemblies are slidably mounted to channel-forming slides on the window frame. The lock assemblies releasably lock the sash in the vent-egress and wash modes.

5 Claims, 13 Drawing Figures

CASEMENT WINDOW

BACKGROUND OF THE INVENTION

This invention relates to casement windows and more particularly, to a vent-egress casement window.

Most fire codes pertinent to casement windows require a twenty inch minimum clear opening width and a 5.7 minimum square feet opening area. Most modern casement windows use concealed hinges which utilize a linkage system that in the fully open position locates the sash somewhat midway between the two jambs. Although this has the obvious advantage of allowing the exterior side of the sash to be washed from inside the building structure, it has the disadvantage of limiting the clear opening width of the window. There are at least three solutions to this problem which are commonly known in the trade: (1) the use of large windows with standard concealed hinges; (2) the use of windows with butt hinges; and (3) the use of windows with redesigned, concealed hinge linkages. Although the fire codes can be satisfied with the first solution, an excessively large window often detracts from the overall aesthetics of a building structure. The use of a large fire egress window as a part of a double or triple casement unit is also restricted. The use of windows with butt hinges instead of concealed hinges allows a large clear opening width, but the washing advantage is sacrificed. Redesigned concealed hinge linkages may move the window sash from the hinge side jamb a lesser distance than standard concealed hinges and satisfy the fire codes, but a suitable wash opening is sacrificed, and the degree to which the movement of the sash from the hinge side jamb can be lessened is limited. The limitation results from possible interference of the sash with the hinge side jamb as the sash is opened.

SUMMARY OF THE INVENTION

It is thus an object of the present invention to provide a casement window that not only can be operated such that the clear opening width exceeds the minimum standards defined by fire egress regulatory agency codes, but also can be positioned such that a person facing the interior side of the window can conveniently wash the exterior side of the sash.

Another object of the invention is to provide a casement window in which both vent-egress and wash modes are achieved with a window frame of minimum possible width.

Further purposes and objects will appear as the specification proceeds.

To achieve these objects, the invention relates to an improved casement window operable in a vent-egress mode and a wash mode wherein the window includes a window frame, a window sash, a hinge mechanism and mode-shifting mechanism. The hinge mechanism includes a sash hinge plate mounted on the sash and a hinge shoe. The hinge shoe has a channel-travelling shoe flange. The hinge mechanism provides pivotal movement of the sash relative to the hinge shoe. The mode-shifting mechanism provides shifting of the sash to and from the vent-egress and wash modes. The mode-shifting mechanism further includes a channel-forming slide member and locking mechanism. The slide member is mounted to the window frame, and the shoe flange is slidably mounted to the slide member. The locking mechanism releasably locks the hinge shoe to the slide member in two positions of the hinge shoe relative to the slide member. One of the two positions is a vent-egress position in which the sash is in the vent-egress mode. The other of the two positions is a wash position in which the sash is in the wash mode.

BRIEF DESCRIPTION OF THE DRAWING

One particular embodiment of the present invention is illustrated in the accompanying drawings wherein.

DETAILED DESCRIPTION OF THE PREFERRED EMBODIMENT

Figure 1:
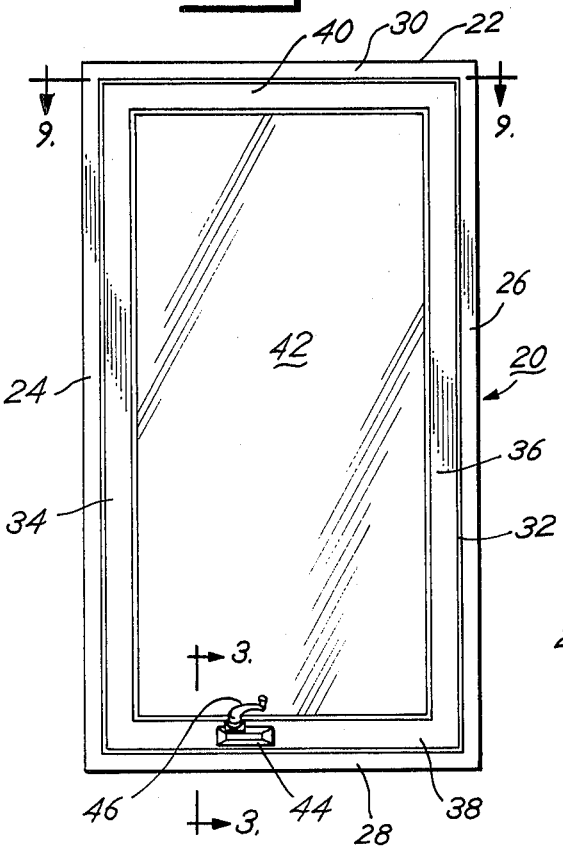
FIG. 1 is an elevation view of the preferred embodiment of the present invention, in a fully closed, vent-egress position.
Figure 2:
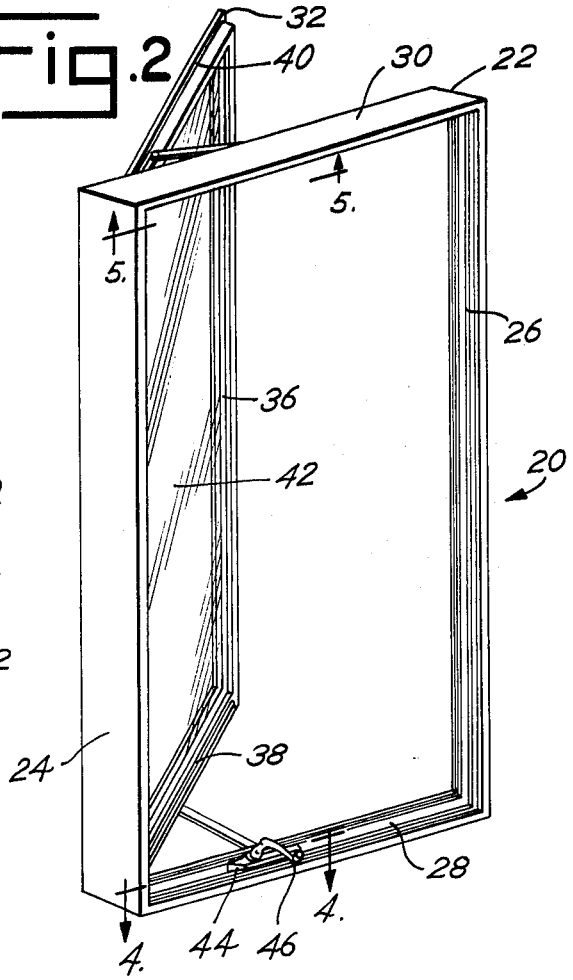
FIG. 2 is a perspective view of the preferred embodiment, in an open, vent-egress position.
Figure 8:
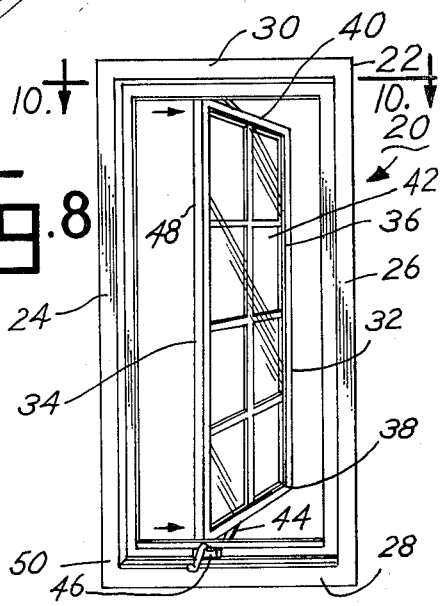
FIG. 8 is a perspective view of the preferred embodiment in the wash position.

Referring to FIG. 1, there is shown a preferred embodiment of the present invention, that is, a casement window 20. The window 20 includes a frame 22 having frame defining members 24, 26, 28, 30; a sash 32 having sash members 34, 36, 38, 40 with a glazing panel 42 supported thereon; and a conventional manual crank mechanism 44 including a crank 46. As shown by comparing FIGS. 1, 2 and 8, the window 20 is operable in two modes, one being a vent-egress mode as shown in FIGS. 1 and 2, and the other being a wash mode, as shown in FIG. 8. In the vent-egress mode, the window 20 is operable in a fully closed position as shown in FIG. 1 and a fully open position (not shown) in which the sash 32 extends substantially perpendicular to the plane of the frame 22. In this mode, the window 20 is also operable in positions between the fully closed and open positions, as illustrated by example in FIG. 2. The window 20 is operated through all these positions by manual manipulation of the crank 46.

In the wash mode, the window 20 is operable principally in a wash position, as shown in FIG. 8. In this position, the sash 32 extends substantially perpendicular to the frame 22. Contrasting the wash position with the fully open position, the sash 32 extends from the frame 22 adjacent the frame side member 24 in the fully open position, while the sash 32 extends from the frame midway between the frame side members 24, 26 in the wash position. Thus, in the wash position, the sash side member 34 shifts from the position it occupies in the vent-egress mode, adjacent the frame side member 24, to a position midway between the frame side members 24, 26. In the wash position of the window 20, the exterior 48 of the glazing panel 42 is available for convenient manual washing by a person positioned on the interior side 50 of the window 20.

The sash 32 is mounted to the frame 22 by a mounting assembly, generally, 52. The assembly 52 includes first and second hinge assemblies 54, 56, first and second mode-shifting mechanisms 58, 60 and stop assembly 62. The mode-shifting mechanisms 58, 60 include shifting means such as slide arrangements 64, 66 and lock assemblies 68, 70.

Figure 3:
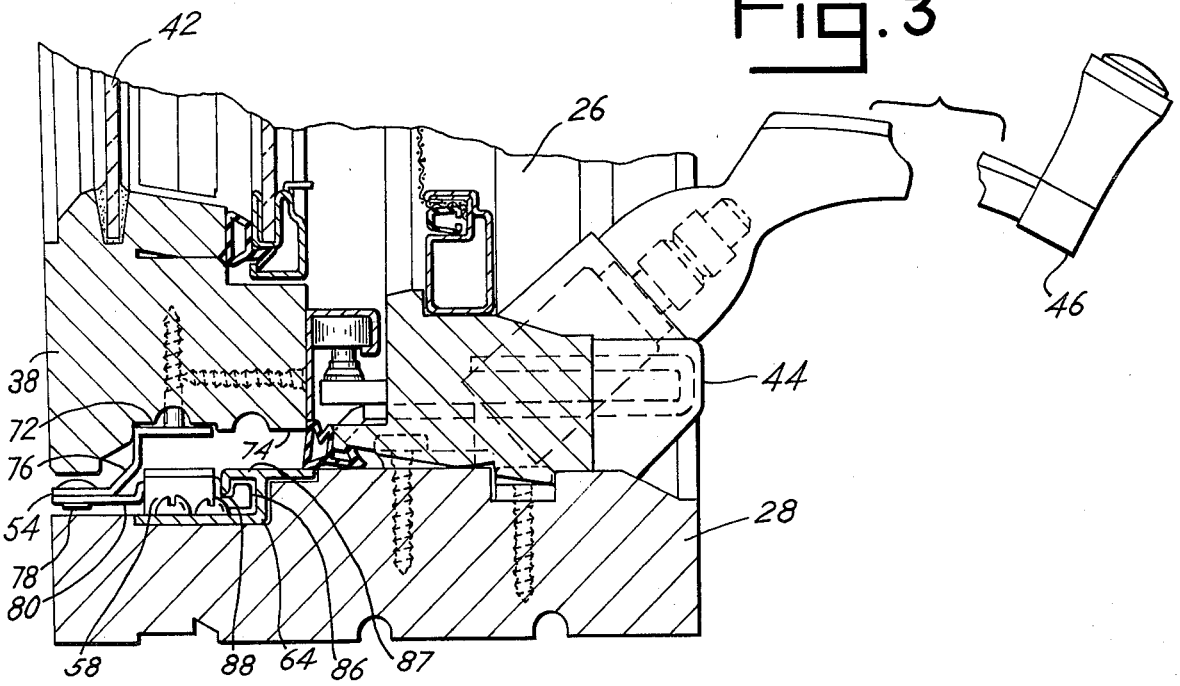
FIG. 3 is a partially broken-away, cross-section view of the preferred embodiment as taken along line 3—3 in FIG. 1.
Figure 4:
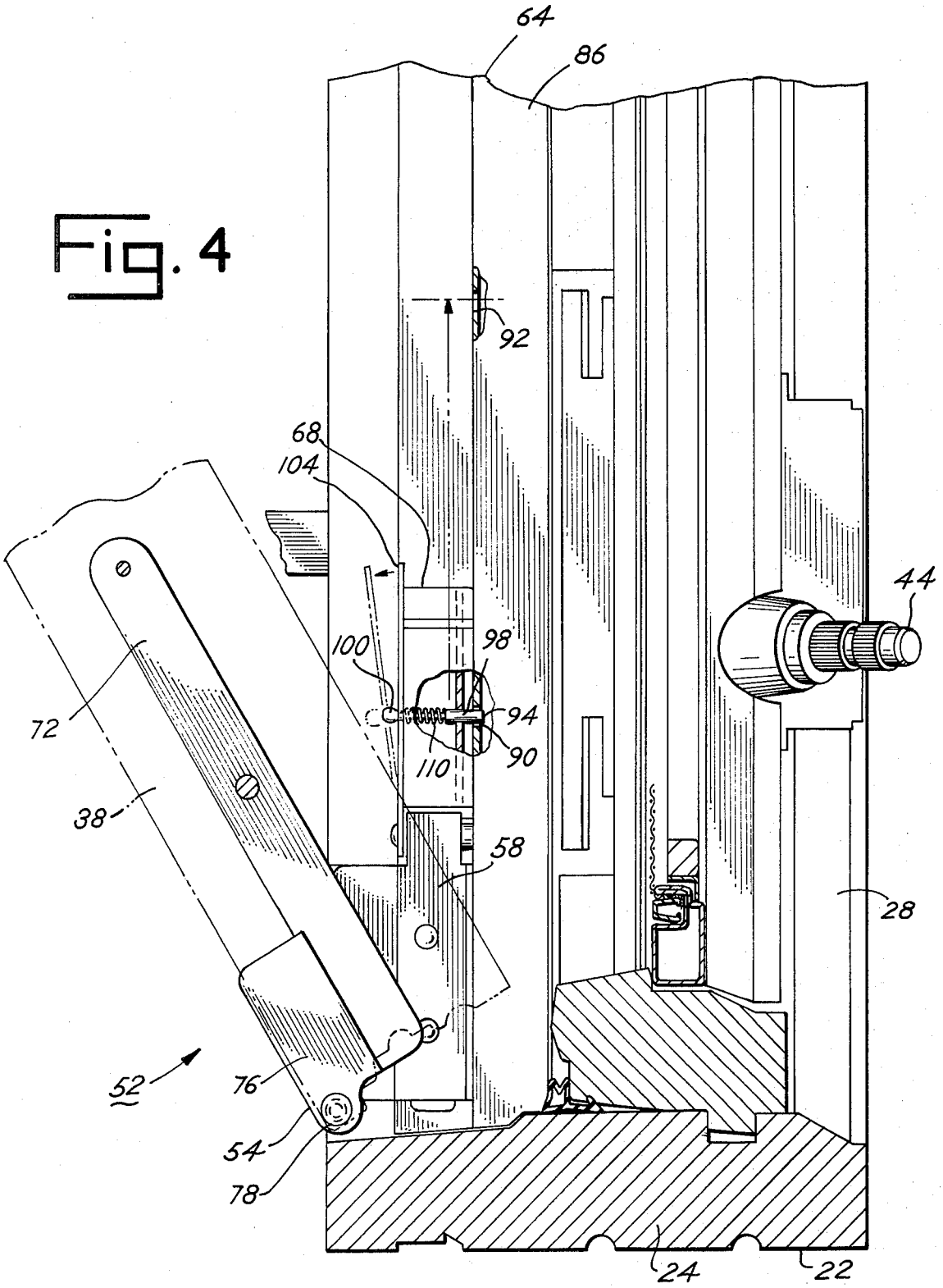
FIG. 4 is a partially broken-away, cross-section view of the preferred embodiment as taken along line 4—4 in FIG. 2.
Figure 5:
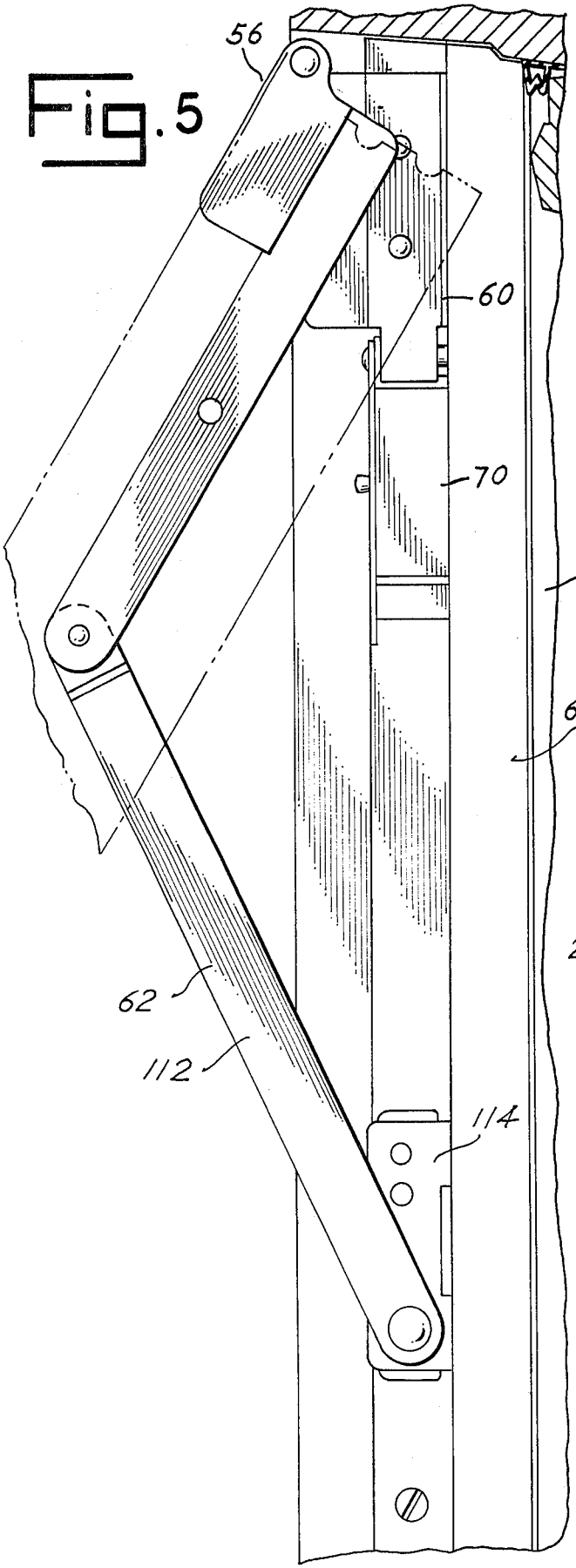
FIG. 5 is a partially broken-away, cross-section view of the preferred embodiment as taken along line 5—5 in FIG. 2.
Figure 13:
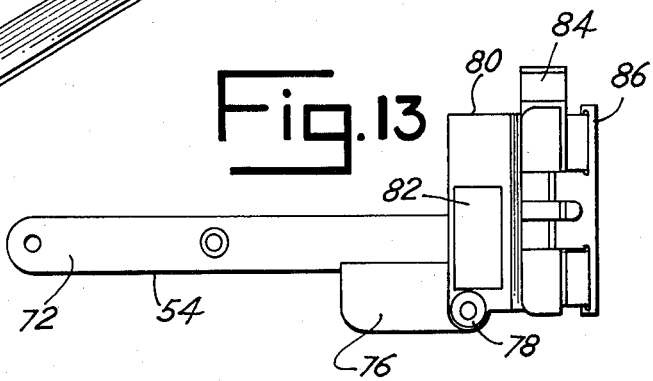
FIG. 13 is a bottom plan view of the hinge assembly of the preferred embodiment of the present invention.

As shown in FIGS. 3, 4 and 13, the hinge assembly 54 includes an elongated, planar pivot plate 72. The plate 72 is mounted to the underside 74 of the bottom sash member 38. An integral plate flange 76 extends outward and downward from an end of the plate 72 to a hinge point 78. At the hinge point 78, the flange 76 is hingedly secured, such as by riveting to a hinge shoe 80. The shoe 80 includes a hinge spacer 82, a hinge shoe support 84 and a channel-travelling flange 86. The assembly 54 provides pivotal movement of the plate 72 and the sash member 38 relative to the shoe 80.

The slide arrangement 64 includes an elongated, channel-forming slide 87, best shown in FIG. 3. The slide 87 is mounted to the bottom frame member 28 and extends along the full extent of the member 28 between the side frame members 24, 26. The slide 87 defines a side-opening channel 88. As shown in FIG. 4, the slide 87 further defines two pinways 90, 92 for receiving a pin 94, to be described. The pinway 90 is a vent-egress-mode pinway, while the pinway 92 is a wash-mode pinway. The pinway 90 is located adjacent the frame side member 24. The pinway 92 is located midway between the frame side members 24, 26.

The hinge shoe 80 is mounted on the slide 87, with the channel-travelling flange 86 slidably mounted in the channel 88. Manual movement of the hinge shoe 80 along the slide 87 causes equivalent movement of the sash 32 relative to the slide 87 and thereby the frame 22. The slide arrangement 64 thus provides for shifting of the sash 32 to and from the vent-egress and wash modes.

Figure 11:
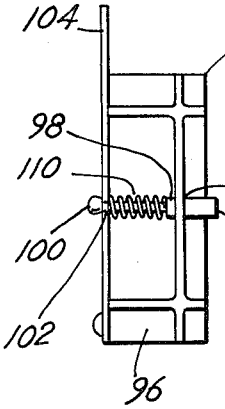
FIG. 11 is a top plan view of the sash hinge lock assembly of the preferred embodiment.

As shown in FIGS. 4 and 11, the lock assembly 68 is mounted on the slide 87, adjacent the hinge shoe 80. The shoe support 84 engages a lock shoe 96 of the assembly 68. The lock shoe 96 and hinge shoe 80 thus travel along the slide 87 as one unit.

Co-operation of the lock assembly 68 with the pinways 90, 92 releasably locks the hinge shoe 80 to the slide 87 in two positions. The assembly 68 co-operates with the pinways 90, 92 through the lock pin 94. The pin 94 has a body 98 and an enlarged head 100. The body 98 extends through a first body opening 102 in a lock release lever 104 and through a second body opening 106 in the lock shoe 96. The head 100 abuts the lever 104 adjacent the opening 102. The lever 104 is movably mounted on the lock shoe 96, as shown by phantom outline in FIG. 4. A spring 110 biases the head 100 into contact with the lever 104.

The pin 94 is movable between a received position in which the body 98 is received by and extends into either of the pinways 90, 92, as in FIG. 4, and a non-received position (not shown). The spring biases the pin to the received position. Movement of the lever 104 causes movement of the pin 94 to the non-received position.

The location of the vent-egress-mode pinway 90 is such that receipt of the pin 94 in the pinway 90 coincides with positioning of the hinge shoe 80 in a vent-egress position. In this position of the shoe 80, the bottom of the sash 32 is in the vent-egress mode. The location of the wash-mode pinway 92 is such that receipt of the pin 94 in the pinway 90 coincides with a wash position of the shoe 80 and the wash mode of the sash 32. Thus, the bottom of the sash 32 is shifted between and locked into the vent-egress and wash modes by manual manipulation of the lever 104 and manual sliding movement of the shoe 80.

The top of the sash 32 is similarly locked and shifted. The hinge assembly 56 and mode-shifting mechanism 60 include all the elements of the assembly 54 and the mechanism 58.

Figure 6:
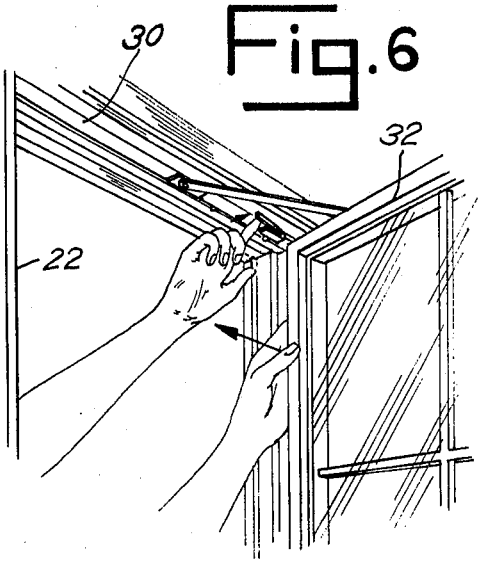
FIG. 6 is a partial perspective view of the preferred embodiment, during a first step of manual manipulation to place the sash in the wash position.
Figure 7:
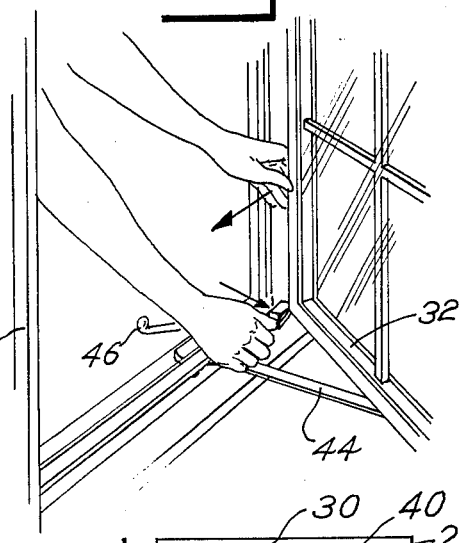
FIG. 7 is a partially broken-away perspective view of the preferred embodiment, during a second step of manual manipulation to place the sash in the wash position.

Illustration of the shifting of the sash 32 to the wash mode is provided in FIGS. 6 and 7. A person desiring to shift the sash opens the sash 32 to an angle relative to the frame of about 45°, presses the top lever 104 to release the top of the sash 32, slides the top of the sash 32 toward the middle of the window opening, presses the bottom lever 104 and slides the sash bottom. When the lock pins 94 reach the pinways 92, they automatically lock the sash in the wash mode.

Figure 9:
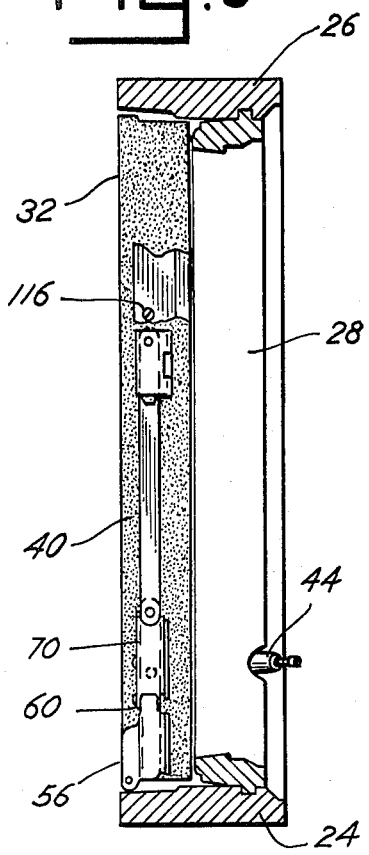
FIG. 9 is a cross-section view of the preferred embodiment as taken along line 9—9 in FIG. 1.
Figure 10:
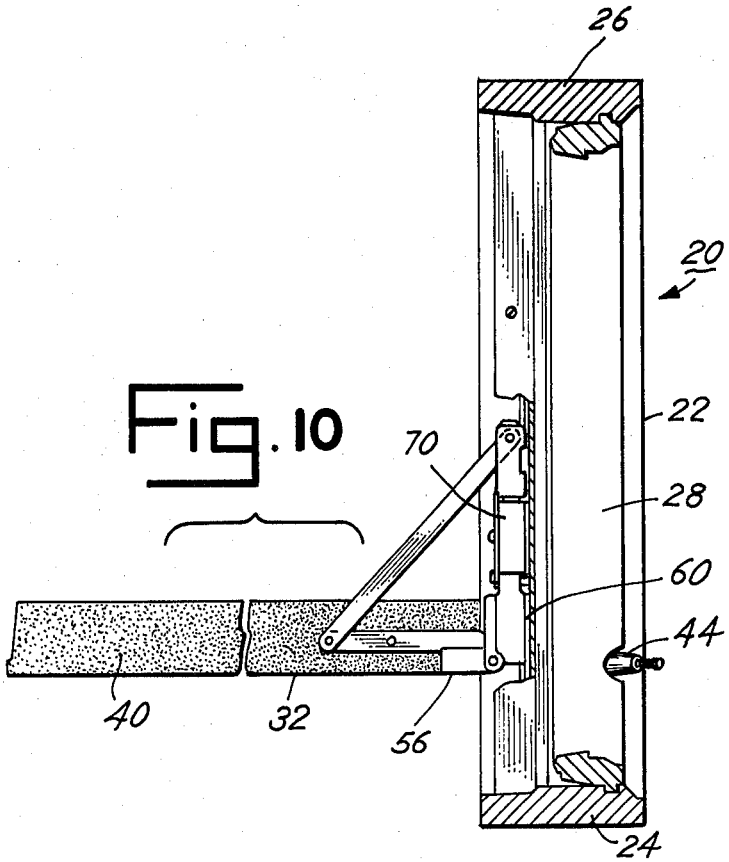
FIG. 10 is a cross-section view of the preferred embodiment as taken along line 10—10 of FIG. 8.
Figure 12:
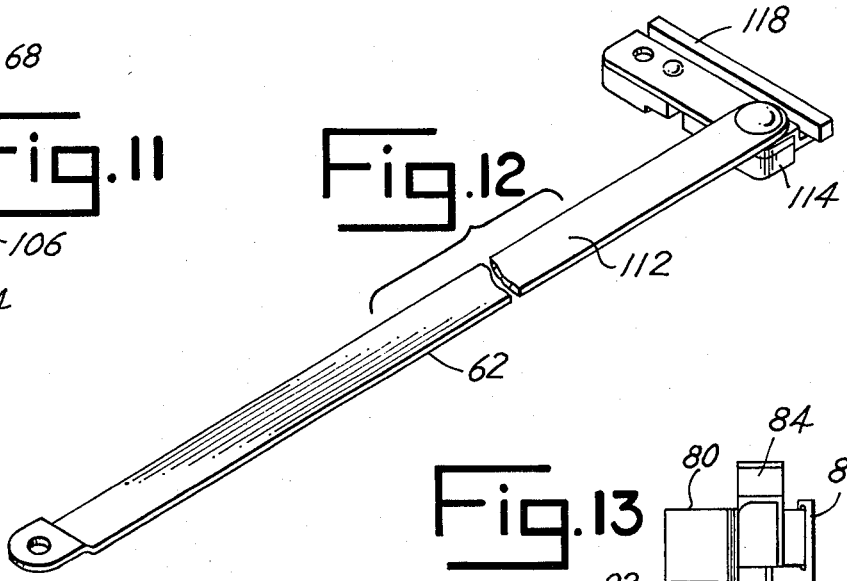
FIG. 12 is a perspective view of the stop link assembly of the preferred embodiment of the present invention.

The stop assembly 62 includes a stop link 112, a stop lock shoe 114 and a stop screw 116, as shown in FIGS. 9, 10 and 12. The shoe 114 has a channel-travelling flange 118 slidably mounted in the channel 88 on the frame member 30. The link 112 is pivotably secured, such as by riveting to the shoe 114 and to the sash member 40. The assembly 62 assures the proper location of the sash top in the frame 22 and retains the sash top in relation to the frame if the hinge assembly 56 fails in service.

While in the foregoing, there has been provided a detailed description of a particular embodiment of the present invention, it is to be understood that all equivalents obvious to those skilled in the art are to be included within the scope of the invention, as claimed.

What I claim and desire to secure by Letters Patent is:

1. A casement window operable in a vent-egress mode and a wash mode comprising:

a window frame;

a window sash movably mounted on said frame;

a sash hinge plate mounted on said sash;

a hinge shoe with a channel-travelling flange member;

hinge means for providing pivotal movement of said sash relative to said hinge shoe, said hinge means being connected to said sashhinge plate and hinge shoe; and mode-shifting means for shifting of the sash to and from the vent-egress and wash modes, the mode-shifting means including a channel-forming slide member secured to the window frame, the channel-travelling flange of the hinge shoe being slidably secured to the slide member, and means for releasably locking the hinge shoe to the slide member in two positions of the hinge shoe relative to the slide member, one of the two positions being a vent-egress position in which the sash is in the vent-egress mode and the other of the two positions being a wash position in which the sash is in the wash mode.

2. A casement window as in claim 1 in which the means for releasably locking the hinge shoe includes a sash hinge lock assembly engaged by the hinge shoe, the sash hinge lock assembly being slidably mounted to the channel-forming slide member and having a lock pin and a lock release lever, the lock pin co-operating with the slide member to lock the hinge assembly to the slide member and the lock release lever co-operating with the lock pin to release the hinge lock assembly.

3. A casement window as in claim 2 in which the slide member has two pinways for receiving the lock pin, one of the pinways being a vent-egress-mode pinway positioned such that receipt of the lock pin in the vent-egress mode pinway locks the hinge shoe to the slide member in the vent-egress position, and the other pinway being a wash-mode pinway positioned such that receipt of the lock pin in the wash-mode pinway locks the hinge shoe to the slide member in the wash position, the lock pin being mounted on the hinge lock assembly for movement between a non-received position in relation to the pinways and a received position in relation to the pinways, and the lock release lever being adapted to move the lock pin between the received position and the non-received position.

4. A casement window as in claim 3 in which the sash hinge lock assembly includes means for biasing the lock pin to the received position, whereby the lock pin, while in the non-received position, automatically moves to the received position upon movement of the sash hinge lock assembly to a position which locates the lock pin at a pinway.

5. A casement window as in claim 4 in which the lock pin has an enlarged head and body, and the lock release lever defines a body opening, the lock pin body extending through the body opening and the head abutting the lock release lever adjacent the body opening, whereby movement of the lock release lever causes following movement of the lock pin.

* * * * *